US006979951B2

(12) United States Patent
Kwon

(10) Patent No.: US 6,979,951 B2
(45) Date of Patent: Dec. 27, 2005

(54) PLASMA DISPLAY PANEL WITH IMPROVED SCREEN QUALITY

(75) Inventor: Hyuk Chae Kwon, Daegu-shi (KR)

(73) Assignee: Orion Electric Co., LTD, Kyoungsangbuk-do (KR)

( * ) Notice: Subject to any disclaimer, the term of this patent is extended or adjusted under 35 U.S.C. 154(b) by 53 days.

(21) Appl. No.: 10/169,471

(22) PCT Filed: Dec. 29, 2000

(86) PCT No.: PCT/KR00/01558

§ 371 (c)(1),
(2), (4) Date: Oct. 4, 2002

(87) PCT Pub. No.: WO01/50493

PCT Pub. Date: Jul. 12, 2001

(65) Prior Publication Data

US 2003/0090203 A1 May 15, 2003

(30) Foreign Application Priority Data

Dec. 30, 1999 (KR) ..... 1999-65666

(51) Int. Cl.[7] ..... H01J 17/04; H01J 9/00; H01J 9/06

(52) U.S. Cl. ..... 313/631; 315/169.4; 445/24; 445/67

(58) Field of Search ..... 315/169.3, 169.4; 313/484, 563, 581, 609–610, 292, 306, 631–632; 445/23–24, 25, 66–67, 72; H01J 17/04, H01J 9/00, 9/06

(56) References Cited

U.S. PATENT DOCUMENTS

| | | | | |
|---|---|---|---|---|
| 3,896,327 | A * | 7/1975 | Schermerhorn | 313/485 |
| 4,185,229 | A * | 1/1980 | Yoshikawa et al. | 315/169.4 |
| 5,136,207 | A * | 8/1992 | Miyake et al. | 313/582 |
| 5,640,068 | A * | 6/1997 | Amemiya | 313/582 |
| 5,659,226 | A * | 8/1997 | Shigeta | 313/491 |
| 5,744,909 | A * | 4/1998 | Amano | 313/585 |
| 5,754,003 | A * | 5/1998 | Murai et al. | 313/582 |
| 5,967,872 | A * | 10/1999 | Betsui et al. | 445/24 |
| 6,124,676 | A * | 9/2000 | Salavin et al. | 315/169.4 |
| 6,281,628 | B1 * | 8/2001 | Choi et al. | 313/585 |
| 6,348,762 | B1 * | 2/2002 | Nunomura et al. | 313/582 |
| 6,445,125 | B1 * | 9/2002 | Na et al. | 313/497 |
| 6,495,967 | B2 * | 12/2002 | Kao et al. | 315/169.4 |
| 6,498,430 | B1 * | 12/2002 | Sakai et al. | 313/582 |

FOREIGN PATENT DOCUMENTS

| | | |
|---|---|---|
| JP | 6-44907 | 2/1994 |
| JP | 6-251712 | 9/1994 |
| JP | 10-308179 | 11/1998 |
| KR | 1998-052817 | 9/1998 |
| KR | 1999-0065917 | 8/1999 |

* cited by examiner

*Primary Examiner*—Thuy Vinh Tran
(74) *Attorney, Agent, or Firm*—Merchant & Gould P.C.

(57) ABSTRACT

The present invention discloses a plasma display panel which can improve screen quality, by dividing a rear substrate into a plurality of regions and by varying a structure of cells in each region, thereby preventing luminance from being reduced according to a process property and an electric property of a panel.

15 Claims, 3 Drawing Sheets

PLASMA DISPLAY PANEL WITH IMPROVED SCREEN QUALITY

This application is a National Phase Application under 35 U.S.C. 371 claiming the benefit of PCT/KR00/01558 filed on Dec. 29, 2000, which has priority based on Republic of Korea Application No. 1999/65666 filed on Dec. 30, 1999.

TECHNICAL FIELD

The present invention relates to a plasma display panel, and in particular to a plasma display panel which can improve screen quality by compensating for luminance reduction due to a process property and an electrical property of the panel, by dividing a rear substrate into a plurality of regions, and forming cells in a different shape in the respective regions.

BACKGROUND ART

A plasma display panel is a flat panel display device for displaying a desired screen, by using luminescence by plasma discharge.

The plasma display panel consists of a front substrate and a rear substrate.

A plurality of electrodes is formed to generate a discharge operation between the front substrate and the rear substrate.

Referring to FIG. 1, in a conventional plasma display panel, X electrodes 3 and Y electrodes 4 are formed on a front substrate 1, and address electrodes 8 are formed on a rear substrate 2. The X electrodes 3, Y electrodes 4 and address electrodes 8 are correspondingly formed in cell units.

Black stripes 5 are formed at the outer portions of the X and Y electrodes 3, 4. A dielectric layer 6 is formed thereon. A protective layer 7 made of MgO protects the dielectric layer 6.

In addition, a dielectric layer 9 is formed on the address electrodes 8 of the rear substrate 2. Cross walls 10 for forming a cell are formed on the dielectric layer 9. A fluorescent layer 11 is formed in-between the cross walls 10.

In the conventional plasma display panel, the front substrate 1 and the rear substrate 2 are combined to face each other, and a discharge gas is filled therein. The discharge operation is selectively performed according to signals from the electrodes. Here, luminescence is generated in an arrow direction by cell unit discharge, thereby displaying a desired screen. In order to obtain desired colors, the respective cells correspond to red(R), green(G) and blue(B).

The cross wall 10 may be formed in various methods, such as a printing process using screen-printing or a sand blasting process. In addition, the cross wall 10 is formed on the rear substrate 2 in a regular lattice structure so as to obtain a minute discharge space, prevent interference with the adjacent cells and obtain a homogeneous screen.

At this time, the process of forming the cross wall in conventional lattice structure abides by the design principle, but does not reflect an actual process property. That is to say, the lattice cross wall is not identically formed in the center and corner portions of the rear substrate, making it difficult to obtain the homogeneous screen. As a result, reliability of the plasma display panel is reduced.

DISCLOSURE OF THE INVENTION

Therefore, a primary object of the present invention is to overcome a structural defect of a plasma display panel due to difference in cells in its center and corner portions, and to improve screen quality, by dividing the plasma display panel into a plurality of regions, and forming the cells in a different shape in the respective regions.

Another object of the present invention is to enhance the reliability of a plasma display panel, by developing a cell structure to provide a homogeneous screen in the center and corner portions of the plasma display panel.

In order to achieve the above-described object of the present invention, there is provided a plasma display panel wherein a front substrate and a rear substrate are assembled, unit cells are formed over the whole surface, the rear substrate is divided into a plurality of regions, and cross walls correspond to the cells so that the cells can have different shapes in each region.

Here, the different shapes of the cells in each region are selected out of combinations of a polygon, circle, straight line and circular arc.

Preferably, the rear substrate is divided into the plurality of regions by a plurality of boundary surfaces having concentric circles.

According to one aspect of the present invention, the rear substrate may be divided into a center region, a middle region and a corner region. In the center region, the cells are formed in a figure shape having circular arcs in its upper and lower portions, and having long sides. In the middle region, the cells have the identical shape to the cells in the center region, but have a larger area. In the corner region on the left side, the cells are formed in a semicircular shape having a circular arc on the left side. In the corner region on the right side, the cells are formed in a semicircular shape having a circular arc on the right side.

According to another aspect of the present invention, the rear substrate is divided into the center region, middle region and corner region. In the center region, the cells are formed in a hexagonal shape having long sides. In the middle region, the cells have the identical shape to the cells in the center region, but have a larger area. In the corner region on the left side, the cells are formed in a semicircular shape having a circular arc on the left side. In the coiner region on the right side, the cells are formed in a semicircular shape having a circular arc on the right side.

According to a third aspect of the present invention, the rear substrate is divided into three regions in a vertical direction. Here, the left region is divided into two regions in a horizontal direction, thereby forming an upper left region and a lower left region. The right region is divided into two regions in a horizontal direction, thereby forming an upper right region and a lower right region. The cells are formed in different shapes in the respective regions.

In the center region, the cells are formed in a figure shape having circular arcs in its upper and lower portions and having long sides, or in a hexagonal shape having long sides.

In the upper left region, the cells are formed in a rectangular shape having a circular arc in its upper portion. The cells in the lower left region are symmetrically formed to those in the upper left region in a horizontal direction. The cells in the upper right region are symmetrically formed to those in the upper left region in a vertical direction. The cells in the lower right region are symmetrically formed to those in the upper right region in a horizontal direction.

In addition, in the upper left region, the cells may be formed in a rectangular shape having its lower surface slanted to the center portion. The cells in the lower left region may be symmetrically formed to those in the upper left region in a horizontal direction. The cells in the upper right region may be symmetrically formed to those in the upper left region in a vertical direction. The cells in the lower right region may be symmetrically formed to those in the upper right region in a horizontal direction.

Here, the center region may be divided into three in a horizontal direction. In the center region, the cells are formed in a figure shape having circular arcs in its upper and lower portions and having long sides, or in a hexagonal shape having long sides.

In this case, the cells in the upper center region and the lower center region are symmetrically formed. In the upper center region, the cells are formed in a rectangular shape having a circular arc or triangle in its upper portion.

MODES FOR CARRYING OUT THE PREFERRED EMBODIMENTS

In accordance with the present invention, a plasma display panel is divided into a plurality of regions, and cells are formed in different shapes in the divided regions of a rear substrate, thereby improving a screen quality.

Figure 1:
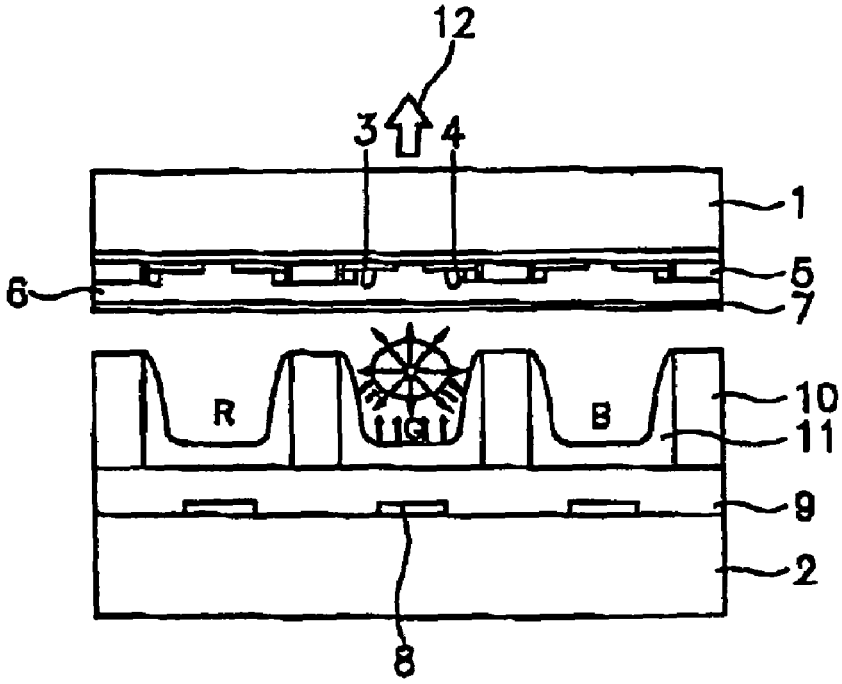
Fig.1 (prior art)
FIG. 1 is a schematic cross-sectional diagram illustrating a conventional plasma display panel.
Figure 2:
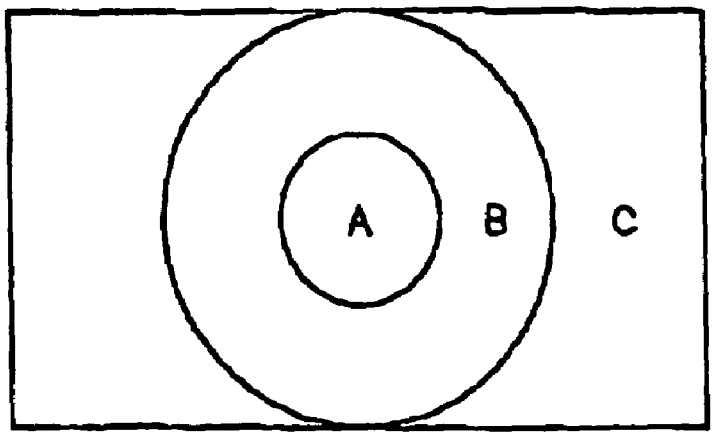
FIG. 2 is a division diagram of a plasma display panel in accordance with a first embodiment of the present invention.
Figure 3:
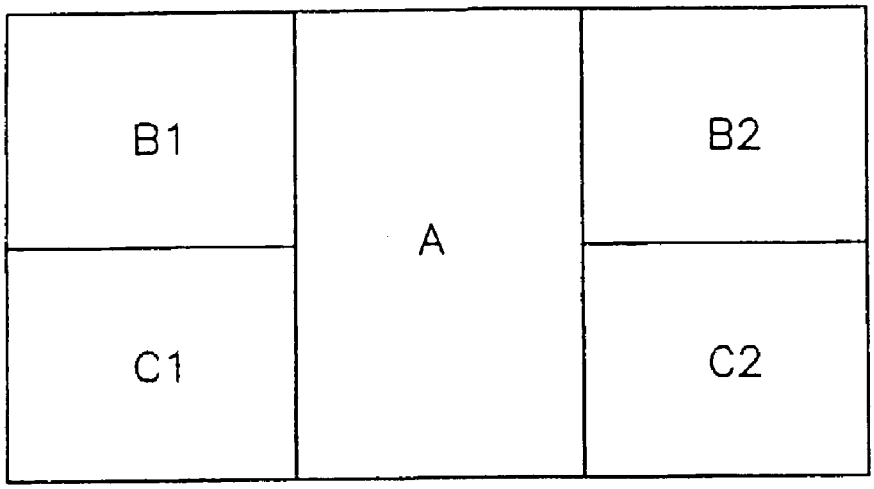
FIG. 3 is a division diagram of a plasma display panel in accordance with a second embodiment of the present invention.
Figure 4:
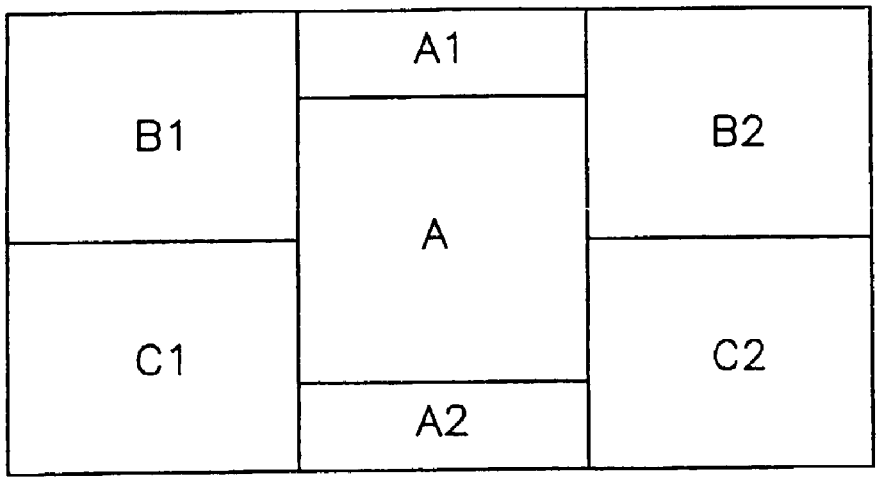
FIG. 4 is a division diagram of a plasma display panel in accordance with a third embodiment of the present invention.

For this, the present invention is variously embodied as in a first embodiment of FIG. 2, a second embodiment of FIG. 3 and a third embodiment of FIG. 4. Here, cell shapes shown in FIG. 5 may be applied to the regions of the plasma display panel in FIGS. 2 to 4.

In more detail, in accordance with the first embodiment of the invention, the plasma display panel is divided into a center region(region A), a middle region(region B) and a corner region(region C). The center region, the middle region and the corner region are again divided by boundary surfaces forming concentric circles.

Figure 5:
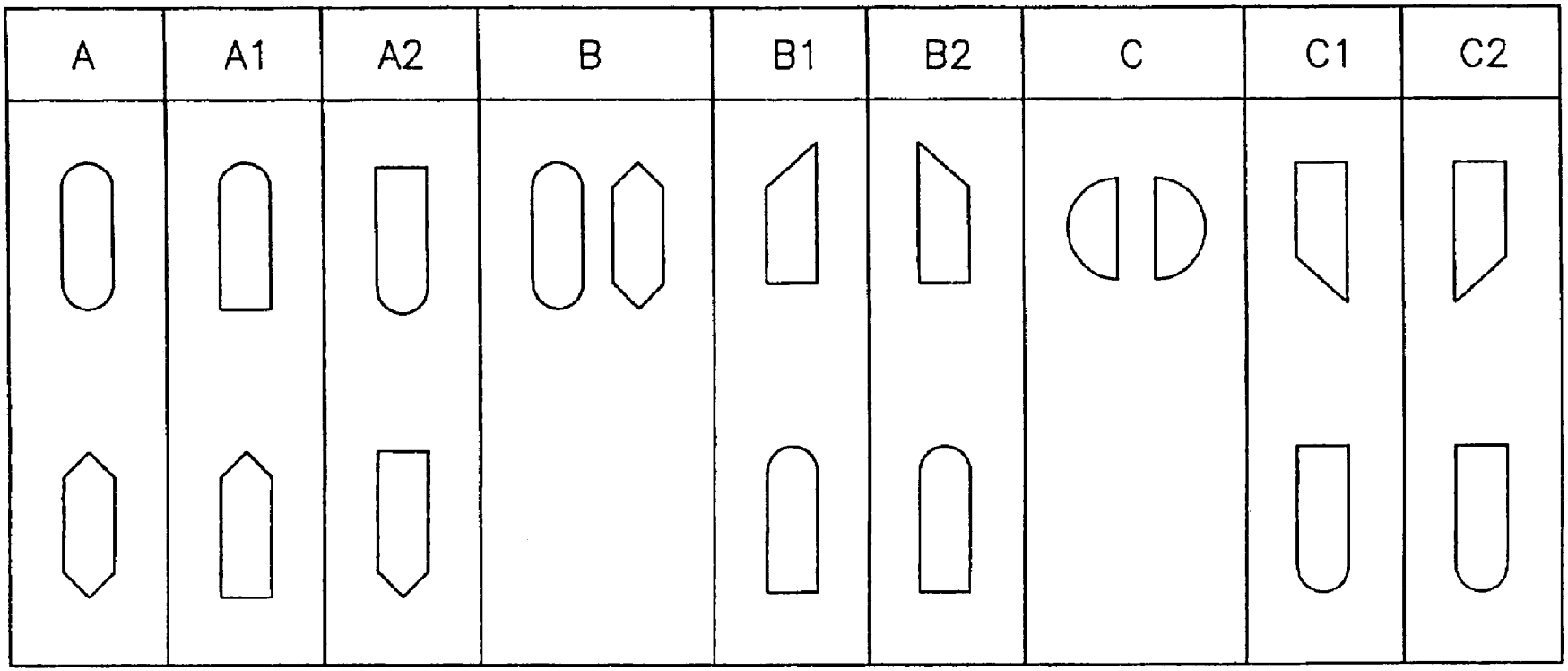
FIG. 5 shows cell shapes used in the embodiments of the present invention.

In region A, as shown in FIG. 5, the cells are formed in a figure shape having circular arcs in its upper and lower portions and having long sides, or in a hexagonal shape having long sides.

In region B, as shown in FIG. 5, the cells are formed in a figure shape having circular arcs in its upper and lower portions and having long sides, or in a hexagonal shape having long sides, identical to region A. Preferably, the size of the cells in region B is identical to or greater than that of the cells in region A.

As depicted in FIG. 2, region C is divided into the right and left sides. In region C on the left side, as illustrated in FIG. 5, the cells are formed in a semicircular shape having a circular arc on the left side. In region C on the right side, as shown in FIG. 5, the cells are formed in a semicircular shape having a circular arc on the right side.

According to the first embodiment of the present invention, the plasma display panel is divided into the center region, the middle region and the corner region, and the cells are formed in different shapes in the respective regions. Therefore, the differences in the screen quality of the center, middle and corner regions can be compensated by optical operations depending on the cell structure, such as reflexibility.

As a result, the whole surface has a homogeneous screen quality. It is also possible to partially vary the cell shapes in the first embodiment of the present invention. In addition, the cell shapes in the second and third embodiments can be applied to optimize the screen quality.

On the other hand, in accordance with the second embodiment of the invention, as illustrated in FIG. 3, the plasma display panel is divided into a center region(region A), an upper left region(region B1), an upper right region(region B2), a lower left region(region C1) and a lower right region(region C2).

As illustrated in FIG. 3, region A is the center region of the plasma display panel divided into three regions in a vertical direction. In region A, as shown in FIG. 5, the cells are formed in a figure shape having circular arcs in its upper and lower portions and having long sides, or in a hexagonal shape having long sides.

The left region of the plasma display panel is again divided into region B1 and region C1 in a horizontal direction.

In region B1, as shown in FIG. 5, the cells are formed in a rectangular shape having a circular arc in its upper portion, or in a rectangular shape having its upper surface slanted to the center portion.

The cells in region C1 are symmetrically formed to those in region B1 in a horizontal direction. In region C1, as shown in FIG. 5, the cells are formed in a rectangular shape having a circular arc in its lower portion, or in a rectangular shape having its lower surface slanted to the center portion.

On the other hand, the right region of the plasma display panel is divided into region B2 and region C2 in a horizontal direction.

The cells in region B2 are symmetrically formed to those in region B1 in a vertical direction. In region B2, as shown in FIG. 5, the cells are formed in a rectangular shape having a circular arc in its upper portion, or in a rectangular shape having its upper surface slanted to the center portion.

The cells in region C2 are symmetrically formed to those in region C1 in a vertical direction. Accordingly, in region C2, as shown in FIG. 5, the cells are formed in a rectangular shape having a circular arc in its lower portion, or in a rectangular shape having its lower surface slanted to the center portion.

In accordance with the second embodiment of the present invention, the plasma display panel is divided into the center region, the upper left region, the upper right region, the lower left region and the lower right region, and the cells are formed in different shapes in the respective regions. Accordingly, the difference in the screen quality of the respective regions can be compensated by optical operations depending on the cell structure, such as reflexibility.

In addition, in accordance with the third embodiment of the present invention, as illustrated in FIG. 4, the center region of the plasma display panel is divided into three in a horizontal direction. The cells are formed in a different shape in the respective regions. That is, the plasma display panel is divided into a center region(region A), an upper center region(region A1), a lower center region(region A2), an upper left region(region B1), an upper right region(region B2), a lower left region(region C1) and a lower right region(region C2).

The plasma display panel is divided into three regions in a vertical direction. The center region is again divided into three regions in a horizontal direction. Here, region A is the center region of the divided regions. In region A, as shown in FIG. 5, the cells are formed in a figure shape having circular arcs in its upper and lower portions and having long sides, or in a hexagonal shape having long sides.

Region A1 is the upper region of the divided regions. In region A1, as shown in FIG. 5, the cells are formed in a rectangular shape having a circular arc or triangle in its upper portion.

Region A2 is the lower region of the divided regions. As depicted in FIG. 5, the cells in region A2 are symmetrically formed to those in region A1 in a vertical direction. Accordingly, in region A2, as shown in FIG. 5, the cells are formed in a rectangular shape having a circular arc or triangle in its lower portion.

The left region of the plasma display panel is divided into a upper left region B1 and a lower left region C1 in a horizontal direction.

In region B1, as illustrated in FIG. 5, the cells are formed in a rectangular shape having a circular arc in its upper portion, or in a rectangular shape having its upper surface slanted to the center portion.

The cells in region C1 are symmetrically formed to those in region B1 in a horizontal direction. Therefore, in region C1, as shown in FIG. 5, the cells are formed in a rectangular shape having a circular arc in its lower portion, or in a rectangular shape having its lower surface slanted to the center portion.

In addition, the right region of the plasma display panel is divided into a upper right region B2 and a lower right region C2 in a horizontal direction.

The cells in region B2 are symmetrically formed to those in region B1 in a vertical direction. Accordingly, in region B2, as shown in FIG. 5, the cells are formed in a rectangular shape having a circular arc in its upper portion, or in a rectangular shape having its upper surface slanted to the center portion.

The cells in region C2 are symmetrically formed to the cells in region C1 in a vertical direction. Therefore, in region C2, as depicted in FIG. 5, the cells are formed in a rectangular shape having a circular arc in its lower portion, or in a rectangular shape having its lower surface slanted to the center portion.

In accordance with the third embodiment of the present invention, the plasma display panel is divided into the center region, the upper center region, the lower center region, the upper left region, the upper right region, the lower left region and the lower right region, and the cells are formed in different shapes in the respective regions. Accordingly, the differences in the screen quality of the respective regions can be compensated by optical operations depending on the cell structure, such as reflexibility.

According to the first to third embodiments of the present invention the cells are formed in different shapes in each region. The cross walls of the rear substrate have a structure suitable for the corresponding shape, and the fluorescent substance is formed in-between the cross walls, thereby forming the various cells in the respective divided regions.

As discribed earlier, the plasma display panel is divided into the plurality of regions, and the cells having different shapes are aligned in the divided regions. As a result, the center region and the corner region can obtain the homogeneous screen quality during the plasma discharge, thereby improving reliability of the plasma display panel.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A plasma display panel wherein a front substrate and a rear substrate are assembled, unit cells are formed over a whole interior surface of the rear substrate, the rear substrate is divided into a plurality of regions, and the cells have different shapes in each region, wherein the rear substrate is divided into a center region, a middle region and a corner region, the cells in the center region are formed in a figure shape having circular arcs in its upper and lower portions and having long sides, the cells in the middle region have an identical shape to the cells in the center region, but have a larger area, the cells in the corner region on a left side of the rear substrate are formed in a semicircular shape having a circular arc on the left side thereof, and the cells in the corner region on a right side of the rear substrate are fanned in a semicircular shape having a circular arc at the right side thereof.

2. A plasma display panel wherein a front substrate and a rear substrate are assembled, unit cells are formed over a whole interior surface of the rear substrate, the rear substrate is divided into plurality of regions, and the cells have different shapes in each region, wherein the rear substrate is divided into a center region, a middle region, and a corner region, the cells in the center region are formed in a hexagonal shape having long sides, the cells in the middle region having an identical shape to the cells in the center region, but have a larger area, the cells in the corner region on a left side of the rear substrate are formed in a semicircular shape having a circular arc on the left side thereof, and the cells in the corner region on a right side of the rear substrate are formed in a semicircular shape having a circular arc on the light side thereof.

3. A plasma display panel wherein a front substrate and a rear substrate are assembled, unit cells are formed over a whole interior surface of the rear substrate, the rear substrate is divided into a plurality of regions, and the cells have different shapes in each region wherein the rear substrate is divided in a vertical direction, and the cells are symmetrically formed in the vertical direction in the corresponding regions.

4. A plasma display panel wherein a front substrate and a rear substrate are assembled, unit cells are formed over a whole interior surface of the rear substrate; and the rear substrate is divided into a plurality of regions, and the cells have different shapes in each region, wherein the rear substrate is divided in a horizontal direction, and the cells are symmetrically formed in the horizontal direction in the corresponding regions.

5. A plasma display panel wherein a front substrate and a rear substrate are assembled, unit cells are formed over a whole interior surface of the rear substrate, the rear substrate is divided into a plurality of regions, and the cells have different shapes in each region, wherein the rear substrate is divided into a left region, a center region, and a right region in a vertical direction, the left region is divided into an upper left region and a lower left region in a horizontal direction, the right region is divided into an upper right region and a lower right region in a horizontal direction, and the cells are formed in different shapes in the respective divided regions.

6. The plasma display panel according to claim 5, wherein the cells in the center region are formed in a figure shape having circular arcs in its upper and lower portions and having long sides.

7. The plasma display panel according to claim 6, wherein the cells in the upper left region are formed in a rectangular shape having a circular are in its upper portion.

8. The plasma display panel according to claim 7, wherein, the cells in the lower left region are symmetrically formed to the cells in the upper left region in the horizontal direction, the cells in the upper right region are symmetrically formed to the cells in the upper left region in the vertical direction, and the cells in the lower right region are symmetrically formed to the cells in the upper right region in the horizontal direction.

9. The plasma display panel according to claim 6, wherein the cells in the upper left region are formed in a rectangular shape having its lower surface slanted to the center region.

10. The plasma display panel according to claim 9, wherein the cells in the lower left region are symmetrically formed to the cells in the upper left region in the horizontal direction, the cells in the upper right region are symmetrically formed to the cells in the upper left region in the vertical direction, and the cells in the lower right region are symmetrically formed to the cells in the upper right region in the horizontal direction.

11. The plasma display panel according to claim 5, wherein the cells in the center region are formed in a hexagonal shape having long sides.

12. The plasma display panel according to claim 5, wherein the center region of the rear substrate is divided into a central region, an upper center region and a lower center region in a horizontal direction, and the cells in the central region are formed in a figure shape having circular arcs in its upper and lower portions and having long sides.

13. The plasma display panel according to claim 12, wherein the cells are symmetrically formed in the upper center region and the lower center region, and the cells are formed in the upper center region in a rectangular shape having a circular arc in its upper portion.

14. The plasma display panel according to claim 12, wherein the cells are symmetrically formed in the upper center region and the lower center region, and the cells in the upper center region are formed in a rectangular shape having a triangle in its upper portion.

15. The plasma display panel according to claim 5, wherein the center region of the rear substrate is divided into a central region, an upper center region and a lower center region in horizontal direction, and the cells in the central region are formed in a hexagonal shape having long sides.

* * * * *